US006761279B1

(12) United States Patent
Martin et al.

(10) Patent No.: US 6,761,279 B1
(45) Date of Patent: Jul. 13, 2004

(54) COMBINED CONTAINER AND CLOSURE

(75) Inventors: Douglas S. Martin, New Castle, PA (US); Joel Wennerstrom, Akron, OH (US)

(73) Assignee: Weatherchem Corporation, Twinsburg, OH (US)

( * ) Notice: Subject to any disclaimer, the term of this patent is extended or adjusted under 35 U.S.C. 154(b) by 268 days.

(21) Appl. No.: 09/779,312

(22) Filed: Feb. 8, 2001

(51) Int. Cl.[7] ..... B65D 51/20

(52) U.S. Cl. ..... 220/258.2; 220/258.1; 220/259.2; 220/847; 220/259.1; 220/254.3

(58) Field of Search ..... 220/359.1, 359.2, 220/258, 259, 847, 837, 836, 839, 784, 787, 789–791, 796, 797, FOR 101, FOR 100, 675, 634, 656, 659, FOR 105, FOR 107, 783, 802, 801, 689–700, 254.3, 254.1, 258.1, 258.2, 259.1; 206/494; 215/232, 237

(56) References Cited

U.S. PATENT DOCUMENTS 2,124,929 A * 7/1938 Reid ..... 220/700
2,683,974 A * 7/1954 Brown ..... 220/700
2,780,386 A * 2/1957 Evans ..... 220/228
3,142,847 A * 8/1964 Kurrels ..... 206/517
3,231,078 A * 1/1966 Balocca et al. ..... 220/359.4
3,933,297 A * 1/1976 Carlsson et al. ..... 229/122.22
4,027,778 A * 6/1977 Tupper ..... 220/798
4,441,625 A * 4/1984 Andersson ..... 220/257
4,819,863 A * 4/1989 Oppedal ..... 229/125.35
4,834,259 A * 5/1989 Kubis et al. ..... 220/359.2
4,856,674 A * 8/1989 Berney ..... 220/780
4,972,963 A * 11/1990 Guarriello et al. ..... 220/659
D318,015 S * 7/1991 DeCoster et al. ..... D9/435
5,474,199 A * 12/1995 Julius et al. ..... 220/259
5,657,894 A * 8/1997 Bowen ..... 220/780
5,667,092 A * 9/1997 Julius et al. ..... 220/259
5,975,346 A * 11/1999 Imperato et al. ..... 220/698
6,068,153 A * 5/2000 Young et al. ..... 220/258
6,116,441 A * 9/2000 Decelles et al. ..... 215/237
6,250,492 B1 * 6/2001 Verbeck ..... 220/495.11

FOREIGN PATENT DOCUMENTS

GB 869478 * 5/1961 ..... 220/FOR 107
GB 2257693 A * 1/1993 ..... 220/258

* cited by examiner

*Primary Examiner*—Robin A. Hylton
(74) *Attorney, Agent, or Firm*—Pearne & Gordon LLP

(57) ABSTRACT

A package, particularly suited for containing viscous foodstuff, comprising a wide-mouth generally rectangular container and a dispensing closure. The closure seals onto the container with a push-on motion and includes a resealable flip-up hinged lid. The container is originally sealed, after being filled, with a seal membrane applied to the container mouth. The closure is configured to permit the seal membrane to be conveniently removed from the container mouth while the closure remains assembled on the container.

9 Claims, 3 Drawing Sheets

COMBINED CONTAINER AND CLOSURE

BACKGROUND OF THE INVENTION

The invention relates to packaging for consumable products, such as foodstuff and, in particular, to an improved container and closure combination.

PRIOR ART

Viscous food products and other similar goods have traditionally been packaged in round jars with screw-on closures. Such packaging has become mundane, largely because of its ubiquity and, therefore, easily overlooked by a consumer on a retail shelf. Moreover, known containers do not lend themselves to high density shipping or high density display on store shelves. Further, traditional jar and twist-on cap packages are inconvenient to use because of the motions required to unscrew the cap, remove a freshness seal, and later to install the cap. Still further, since the cap typically must be removed from the container to dispense its contents, extra attention must be given to setting the cap aside while the product is dispensed and then reinstalling it.

SUMMARY OF THE INVENTION

The invention provides a container and closure package that affords increased convenience to the consumer or user. Additionally, the package, with a quasi-rectangular shape, affords greater packaging density and stackability features important to the manufacture of the product contained in the disclosed package and to the distributor and marketer of the package. The package, which is particularly suited for viscous foodstuffs, has a seal membrane across the mouth of the container which ensures that the desired original sealing integrity is obtained. The closure has two mating parts, a base and a lid, preferably tethered together by a strap-like hinge. The closure is assembled on the container with a push-on motion. It its assembled condition, the closure enables the user to open the lid and easily remove the seal membrane. The disclosed closure construction thus avoids the necessity of taking the base off the container to remove the seal membrane. The closure base creates a moisture and oxygen-resistant mechanical seal with the container and the lid is similarly resealable with the base. A wide opening character of the closure as well as the mouth of the container enables the user to readily scoop or spoon out substantially all of the contents of a container without difficulty. If desired, when the container is emptied, the base of the closure can be removed from the container to enable these components to be scrubbed clean and the package to be re-used by the consumer.

DESCRIPTION OF THE PREFERRED EMBODIMENT

Figure 1:
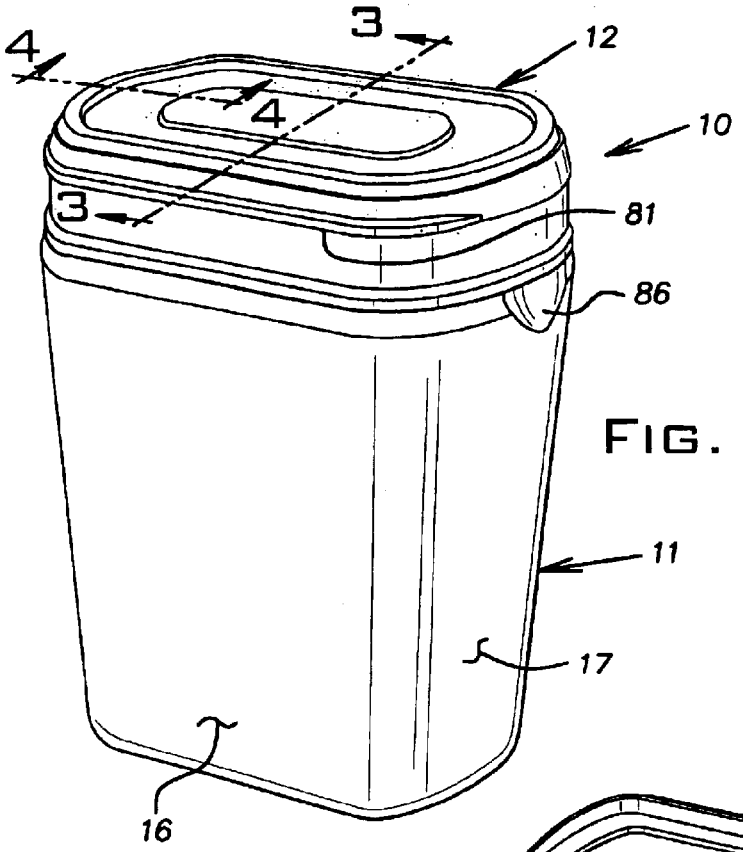
FIG. 1 is a perspective view of a package constructed in accordance with the present invention.
Figure 2:
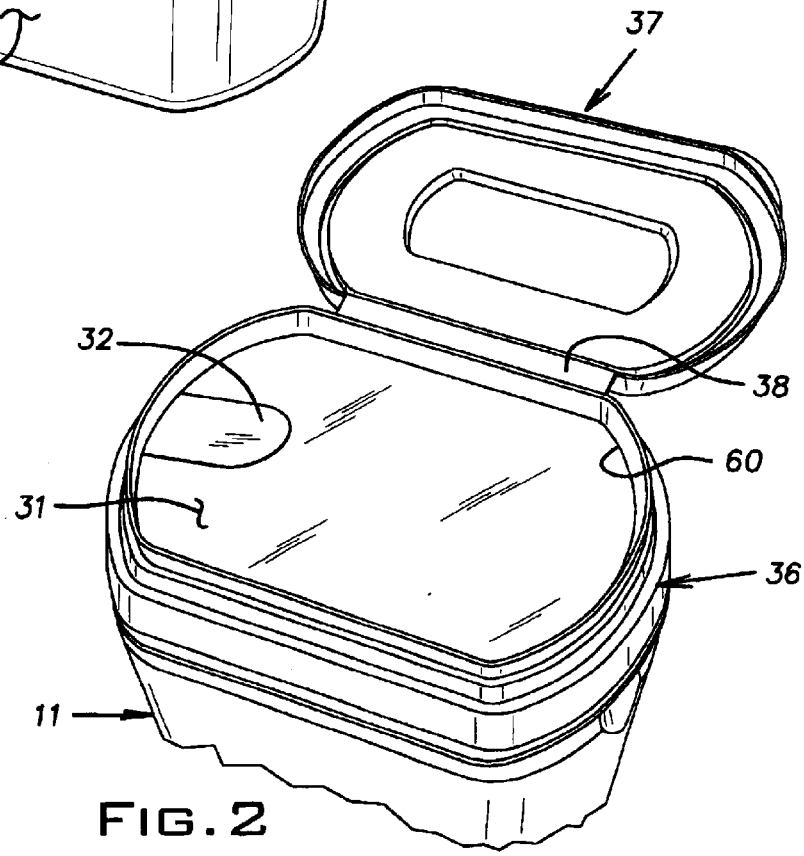
FIG. 2 is a fragmentary perspective view of the package with a lid open and a seal membrane exposed.

Referring now to the drawings, there is shown a package 10 comprising a container 11 and a closure 12. The container or bottle 11 is preferably injection blow-molded of a suitable thermoplastic material such as polyethylene terephthalate. In the following description, the various orientations of parts are in reference to the package 10 being upright as shown in the drawings. As shown, the container 11 is somewhat box-shaped having opposed generally flat vertical main faces 16 and opposed somewhat cylindrical end faces 17. In plan view and in horizontal section, the container 11 and closure 12 have generally rectangular profiles with straight sides and somewhat rounded ends.

Figure 3:
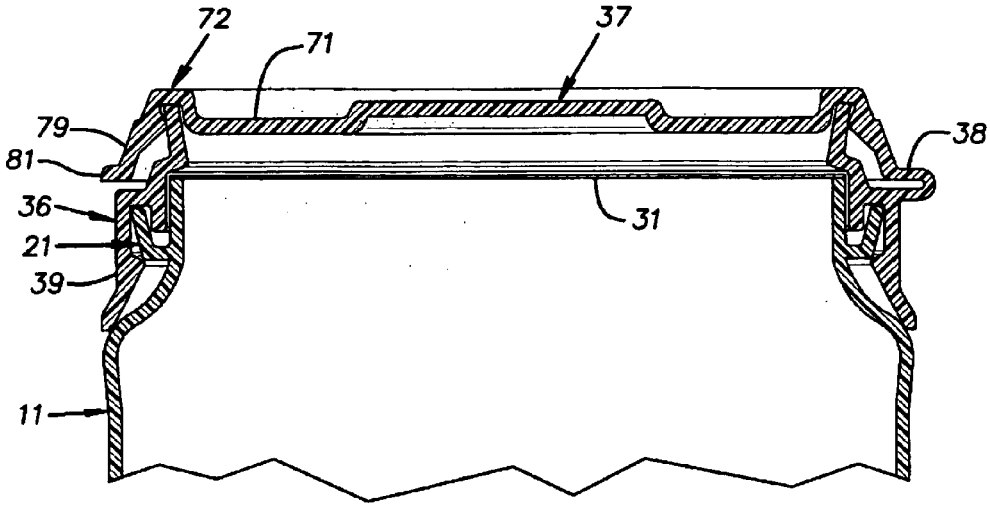
FIG. 3 is a fragmentary cross-sectional view of the package taken in the plane 3—3 in FIG. 1.
Figure 4:
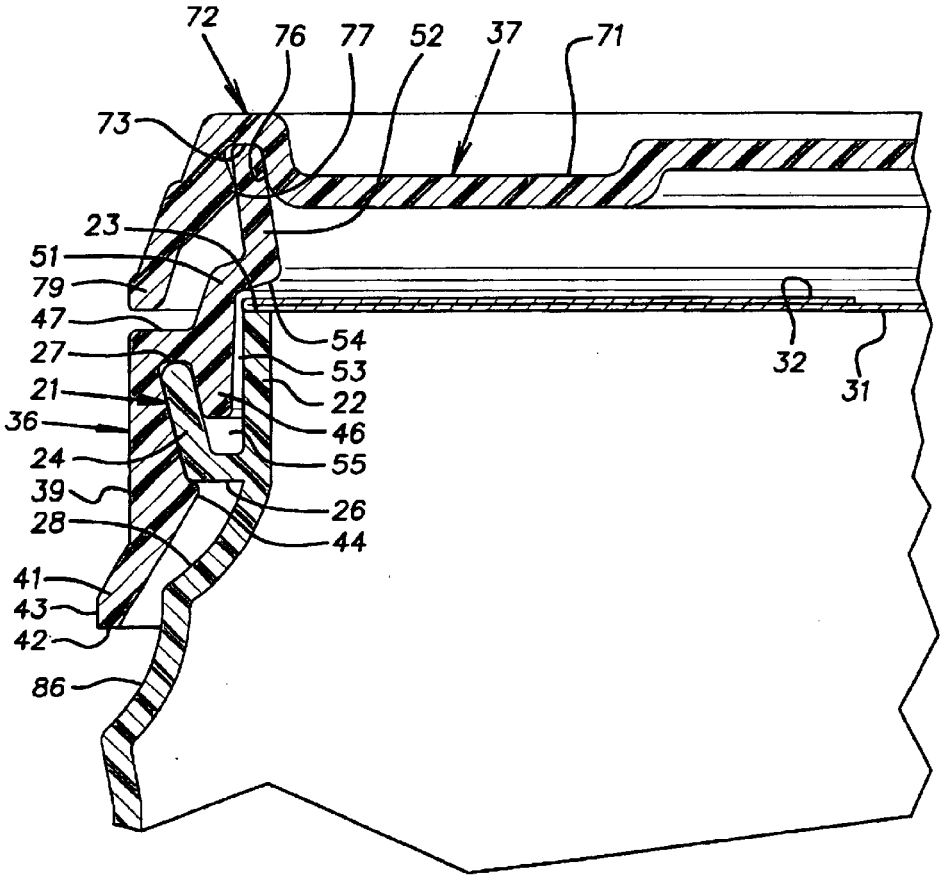
FIG. 4 is a fragmentary cross-sectional view of the package taken in the plane 4—4 in FIG. 1.

As shown in FIGS. 3 and 4, a mouth 21 at an upper face or end of the container 11 has a neck finish that is substantially uniform, in vertical cross-section, along its periphery. As is customary in the art, the mouth or neck finish 21 can be injection molded and the remainder of the container 11 can be blow molded. The mouth or neck finish 21 includes an upstanding generally vertical wall 22 with an upper lip surface 23 that, ideally, is relatively flat across a major part of the thickness of the wall and lies in a flat plane across the mouth of the container. Parallel with and outward of the mouth vertical wall 22 is a closure support in the form of an upstanding wall 24 and a generally horizontal web 26 joining these walls. In the illustrated arrangement, an upper end 27 of the support wall 24 is somewhat lower than or recessed below the lip 23 of the mouth vertical wall 22. Below the horizontal web 26 of the neck finish, the container 11 has a peripheral shoulder 28 that flares outwardly to the main and end faces 16, 17 of the container. The container 11 has a bottom integral with the lower edges of the faces or sides 16, 17.

A seal membrane, known in the art, of suitable material such as plastic, metal or paper or a combination of the same is releasably sealed on the lip 23 of the container 11 with an adhesive, application of heat, or like known technique. The membrane 31 is cut with a profile that closely matches the contour of the outer margin of the lip 23. The membrane 31, preferably, includes an integral pull tab 32 that is folded back over the main body of the membrane.

The illustrated closure 12 comprises a base 36 and a lid 37 that preferably are unitary with one another and are joined with a flexible strap-like hinge 38. Preferably, the closure 12 is injection molded of suitable thermoplastic material such as flexible polyethylene. The base 36 has an annular configuration in plan view like that of the mouth 21 of the container 11. The shape can be characterized as a rectangle with rounded short ends. The base 36 has a somewhat irregular, stepped cross-section in a vertical plane that is substantially uniform around its full perimeter. The base 36 has a lower generally vertically depending skirt 39. A bottom area 41 of the skirt 39 flares slightly outwardly and at an edge or bottom lip 42 has an outer surface area 43 substantially flush with the adjacent outer surface of the container 11. The area above the container shoulder 28 is adapted to receive the bottom area 41 of the skirt 39 to enable a substantially flush fit of the skirt 39 with the faces 16, 17 of the container 11. The depending skirt 39 is thickened at its mid-section to produce an inwardly projecting hook or catch 44.

The base 36 includes a depending inner skirt or wall 46 joined to the outer skirt or wall 39 by a web 47. The skirts 39 and 46 are proportioned and spaced from one another so that their respective inner and outer surfaces are adapted to securely engage the upstanding support wall 24 and effect a moisture and oxygen-excluding mechanical squeeze seal with the same. Above the web 47 and inner skirt 46, the base 36 includes an offset flange area 51 that extends upwardly and inwardly to an inner peripheral wall 52. The wall 52 is generally vertical but with a slight outward flare. The wall 52 is preferably arranged such that when the base 36 is installed on the container neck, it overlies the neck wall 22 and is substantially coplanar with this wall. Additionally, it will be seen that with the base 36 installed, an annular gap 53 exists between the neck wall 22 and web 26 on the container and the inner skirt 46 and flange 51 on the base 36 of the closure 12. The gap 53 includes a vertical space 54 between the neck seal lip 23 and seal membrane 31 and the flange 51 at the base of the upstanding wall 52. The gap 53 further includes a space 55 between a lower end of the inner skirt 46 and the web 26.

Figure 5:
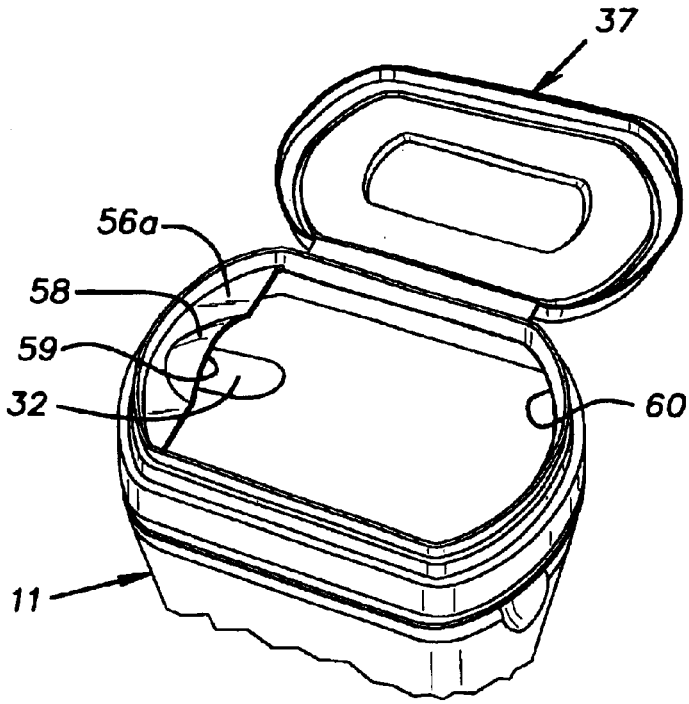
FIG. 5 is a fragmentary perspective view of a modified form of a closure base of the package.
Figure 6:
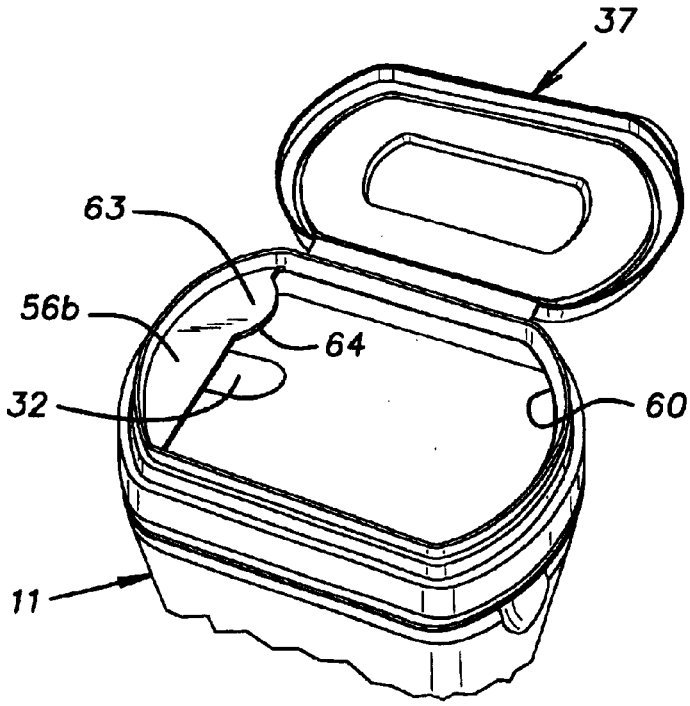
FIG. 6 is a fragmentary perspective view of another modified form of a closure base of the package.

The base 36 forms a central aperture 60 that is generally coextensive with the container mouth opening formed by the wall 22. FIG. 5 illustrates a form of a scraping bar 56*a* wherein an arched wall area 58 is formed to facilitate scraping of the hollow of an inverted spoon. A free edge 59 of the arched wall area 58 lies in a common vertical plane with adjacent free edge areas of the main part of the bar so that flat or spoon utensils can be scraped by raising the same in a vertical plane against these edge areas. FIG. 6 illustrates a second construction of a scraping bar 56*b*. The bar 56*b* includes a flat projection in the horizontal plane of its main portion. The projection 63 extends inward towards the center of the base 36 and has an arcuate edge 64 when viewed from above. The projection 63 permits a spoon to be scraped against it to deposit excess product back into the container. As suggested in FIGS. 5 and 6, the scraping bars 56*a*, 56*b* are spaced above the seal membrane 31.

As mentioned above, the lid 37 is integrally molded with the base 36 through a flexible hinge or strap 38. The lid 37 has a profile or plan view similar to the closure base and the neck 21 of the container 11. A major central area 71 of the lid 37 serves to close the mouth 21 of the container 11 and a periphery 72 of the lid 37 serves to mechanically seal with the base 36 to exclude moisture and oxygen. The lid periphery 72 has an inverted J-shaped cross-section forming a pocket or groove 73 for receiving the upstanding wall 52 of the base. Opposed surfaces 76, 77 forming the pocket 73 engage opposite sides of the wall 52 to ensure a positive squeeze seal with the base 36. A slightly outward flare of the wall 52 and a snug fit of the lid 37 to the wall assures that the lid will close on the base 36 with a positive grip or snap action. An outer wall 79 depends below the plane of the central area 71 so that when the lid is closed this wall or skirt shrouds the wall 52 and flange 51 of the base.

The lid 37 has its upper surface configured to receive and stabilize the bottom of a container identical to the one shown for stacking purposes. A tab 81 projects horizontally outwardly from the peripheral lid wall 79 along the side opposite the hinge 38. The tab 81 enables the lid 37 to be opened with an upward force applied thereto at the right or left of the container, considering the face of the container away from the hinge 38 to be its front.

The package 10 is suitable for containing a variety of product including foodstuffs and is especially useful for containing viscous spreadable foods. Once the container 11 is filled with product, the seal membrane 31 is applied and sealed to the lip 23. With the pull tab 32 folded back over the main body of the seal membrane 31, the closure 12 is assembled to the container 11 with a push-on motion. This is most conveniently done with the lid 37 having been previously closed on the base 36. The outwardly flared area 41 of the base skirt 39 facilitates alignment of the base 36 to the container mouth 21. The hook 44 on this skirt 39 snaps under the juncture of the container neck wall 24 and web 26 to securely retain the base 36 on the container neck 21. A consumer or user of the package 10 opens the package by first prying the lid 37 from the base 36 by pushing the horizontal tab 81 upwardly and causing the lid to flip up on the hinge 38. With the lid 37 open, the pull tab 32 is pulled to cause the seal membrane 31 to peel off the lip 23. It will be understood that the gap 53 including the portion 54 prevents any accidental pinching of the seal membrane between the lid 37 and base 36 which might otherwise occur even where the seal membrane is oversized or imperfectly registered with the lip 23. The retention of the base 36 to the neck 21 is substantially greater than that between the lid 37 and the base so that the lid opening forces cannot cause the base to be accidentally displaced from the container. Typically only a portion of the whole of the product contained in the container is spooned out at a given time. When sufficient product has been removed, the lid 37 is pressed back down and snapped closed onto the base. When the container 11 is emptied of its original product contents, the base 36 can be removed from the container to enable the container to be cleaned and re-used. Finger recesses 86 molded into the end walls 17 enable a person to pry the base 36 off the container 11 by grasping the depending skirt 39 of the base at these locations.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A package comprising a container having a mouth, a sealing membrane on the mouth of the container, and a reclosable dispensing closure overlying the container mouth and the sealing membrane, the closure including a base with a central dispensing aperture and a movable lid for alternately opening or closing the aperture, the seal membrane being releasably secured to the container across the mouth, the base being receivable on the container around the mouth laterally outwardly of the mouth in a fully assembled position wherein surfaces of the base and the container are inter-engaged, the base being spaced from the seal member when the base is fully assembled on the container whereby, with the lid moved to open the container, the seal membrane can be removed from the container by operations conducted through the base aperture without risk that the seal membrane can be pinched between the closure and the container.

2. A package as set forth in claim 1, wherein said closure is arranged for full assembly on the container by a push-on motion.

3. A package as set forth in claim 2, wherein the base and container are arranged to effect a snap inter-engagement when the closure is assembled on the container.

4. A package as set forth in claim 1, wherein the lid and base are arranged to snap together when the lid is closed on the base.

5. A package comprising a container and a closure, the container being an injection blow-molded thermoplastic body, the closure being an injection molded thermoplastic body, said closure comprising a base with a central aperture and flip up lid for opening and closing said aperture, the container having a neck finish with concentric generally upstanding inner and outer walls, a seal membrane sealed to the inner wall, the closure having surfaces complimentary to and in sealing engagement with the outer container wall as a result of being assembled on said container with a push-on motion, the closure is provides a gap between it and the inner container wall of a size sufficient to avoid pinching the seal membrane between the closure and the container neck finish and said seal membrane is removable from the container inner wall by pulling on it through the base aperture.

6. A package as set forth in claim 5, wherein said seal member has an integral pull tab associated with it, said pull tab being disposed on a top surface of said seal member and being accessible through said aperture.

7. A package as set forth in claim 5, wherein said outer wall is recessed vertically below said inner wall.

8. A package as set forth in claim 5, wherein said closure has opposed surface areas that engage opposed sides of said outer container wall.

9. A package as set forth in claim 5, wherein said base and lid have mutually engageable surfaces that tend to snap together when the lid is closed on the base.

* * * * *